US006174037B1

(12) United States Patent
Donahue et al.

(10) Patent No.: US 6,174,037 B1
(45) Date of Patent: Jan. 16, 2001

(54) MULTIPLE PASS INK JET PRINTER WITH OPTIMIZED POWER SUPPLY

(75) Inventors: Frederick A. Donahue; Donald M. Stevens, both of Walworth, NY (US)

(73) Assignee: Xerox Corporation, Stamford, CT (US)

( * ) Notice: Under 35 U.S.C. 154(b), the term of this patent shall be extended for 0 days.

(21) Appl. No.: 08/867,644

(22) Filed: Jun. 2, 1997

(51) Int. Cl.[7] ..... B41J 29/38
(52) U.S. Cl. ..... 347/9
(58) Field of Search ..... 347/9, 12, 37, 347/40, 41, 43, 19

(56) References Cited

U.S. PATENT DOCUMENTS

| | | | | |
|---|---|---|---|---|
| 4,748,453 | | 5/1988 | Lin et al. | 346/1.1 |
| 5,097,189 | * | 3/1992 | Ito et al. | 347/37 |
| 5,349,905 | | 9/1994 | Taylor et al. | 101/488 |
| 5,382,101 | | 1/1995 | Iguchi | 400/124.03 |
| 5,477,246 | * | 12/1995 | Hirabayashi et al. | 347/43 |
| 5,548,308 | * | 8/1996 | Nagatomo et al. | 347/9 |
| 5,610,638 | | 3/1997 | Courtney | 347/14 |

* cited by examiner

*Primary Examiner*—John Barlow
*Assistant Examiner*—Charles W. Stewart, Jr.

(57) ABSTRACT

A liquid ink printer in which liquid ink is deposited on a recording medium in swaths in response to image data received thereby including a power supply, having a maximum power rating determined as a function of a number of passes per swath necessary to compete a swath having maximum ink coverage. The printer includes a print power regulation circuit, including a regulation circuit input, for receiving the image data, and a regulation circuit output, for transmitting image data in a number of passes per swath, the number of passes per swath being determined as a function of the maximum power rating, and a liquid ink printhead, coupled to the power supply and to the print power regulation circuit, for ejecting the liquid ink according to the transmitted image data. A printer driver, which can include the print power regulation circuit, determines the amount of ink coverage to complete a received swath of information and in response thereto determines the number of passes necessary to complete the printing of the swath. The power rating of the controlled according to the number of passes per swath and provides for an optimized power supply.

3 Claims, 3 Drawing Sheets

MULTIPLE PASS INK JET PRINTER WITH OPTIMIZED POWER SUPPLY

FIELD OF THE INVENTION

This invention relates generally to liquid ink printers and more particularly to a multiple pass ink jet printer with an optimized power supply with the maximum number of multiple passes per printing swath being determined as a function of the power supply power rating.

BACKGROUND OF THE INVENTION

An ink jet printer of Liquid ink printers of the type frequently referred to as continuous stream or as drop-on-demand, such as piezoelectric, acoustic, phase change wax-based, or thermal, have at least one printhead from which droplets of liquid ink are directed towards a recording medium. Within the printhead, the ink is contained in a plurality of ink conduits or channels. Power pulses cause the droplets of ink to be expelled as required from orifices or nozzles at the ends of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges toward the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated, at a constant speed, to print one swath of information (equal to the length of a column of nozzles), at a time, on a stationary recording medium, such as paper, fabric, or a transparency. After the swath is printed the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of the recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959, herein incorporated by reference.

Printers typically print information received from an image output device such as a personal computer. Typically, this received information is in the form of a raster scan image such as a full page bitmap or in the form of an image written in a page description language or a combination thereof. The raster scan image includes a series of scan lines consisting of bits representing pixel information in which each scan line contains information sufficient to print a single line of information across a page in a linear fashion.

Printers can print bitmap information as received or can print an image written in the page description language once converted to a bitmap consisting of pixel information.

Various methods and apparatus for printing images with scanning carriage type liquid ink printers have been developed. The following references describe these and other methods and apparatus for liquid ink printing.

In U.S. Pat. No 4,748,453 to Lin et al., a method of depositing spots of liquid ink upon selected pixel centers on a substrate to prevent the flow of liquid ink from one spot to an overlapping adjacent spot by printing a line of information in at least two passes is described. In each pass, spots of liquid ink are deposited in a checkerboard pattern where only diagonally adjacent pixel areas are deposited in the same pass.

U.S. Pat. No 5,349,905 to Taylor et al. describes a method and apparatus for controlling peak power requirements of a printer. The printer incorporates a copy speed feed control for reducing peak power requirements. The speed of the sheet transport system is controlled in accordance with the image density so that high image densities, the speed of the sheet at the printer and/or at the dryer is reduced.

U.S. Pat. No 5,382,101 to Iguchi describes a printer driving apparatus for a dot matrix type printer. A measuring circuit measures the number of print drops and a driving circuit changes the drive timings of the dots of a printhead in correspondence to a print ratio in each print cycle. When high speed printing is not required, the capacity of the power source can be reduced. By reducing the print speed, the printing can be performed by a cheap power source.

U.S. Pat. No 5,610,638 to Courtney describes controlling the printing of an image by a thermal ink jet printer based on an internal temperature of the printer and the density of the printed image. Prior to printing, the temperature of the printhead is estimated and the density of the image is determined from stored print data. Also, based on the temperature and density, the printhead droplet ejection rate is set.

SUMMARY OF THE INVENTION

In accordance with one aspect of the present invention, there is provided a liquid ink printer in which liquid ink is deposited on a recording medium in swaths in response to image data received thereby. The liquid ink printer includes a power supply, including a power rating, a print power regulation circuit, including a regulation circuit input, for receiving the image data, and a regulation circuit output, for transmitting image data in a number of passes per swath, the number of passes per swath being determined as a function of the power rating, and a liquid ink printhead, coupled to the power supply and to the print power regulation circuit, for ejecting the liquid ink according to the transmitted image data.

Pursuant to another aspect of the invention, there is provided a method for controlling the amount of power required by a scanning printhead, of a liquid ink printer including a power supply having a power rating, the printhead including drop ejectors for depositing liquid ink in a number of passes for complete printing of a swath of image data. The method includes the steps of selecting one of a plurality of relationships between the drop ejector behavior and the power supply rating, generating drop ejector behavior information as a function of the selected relationship, and storing the generated behavior information in a memory location for access during operation of the liquid ink printer.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
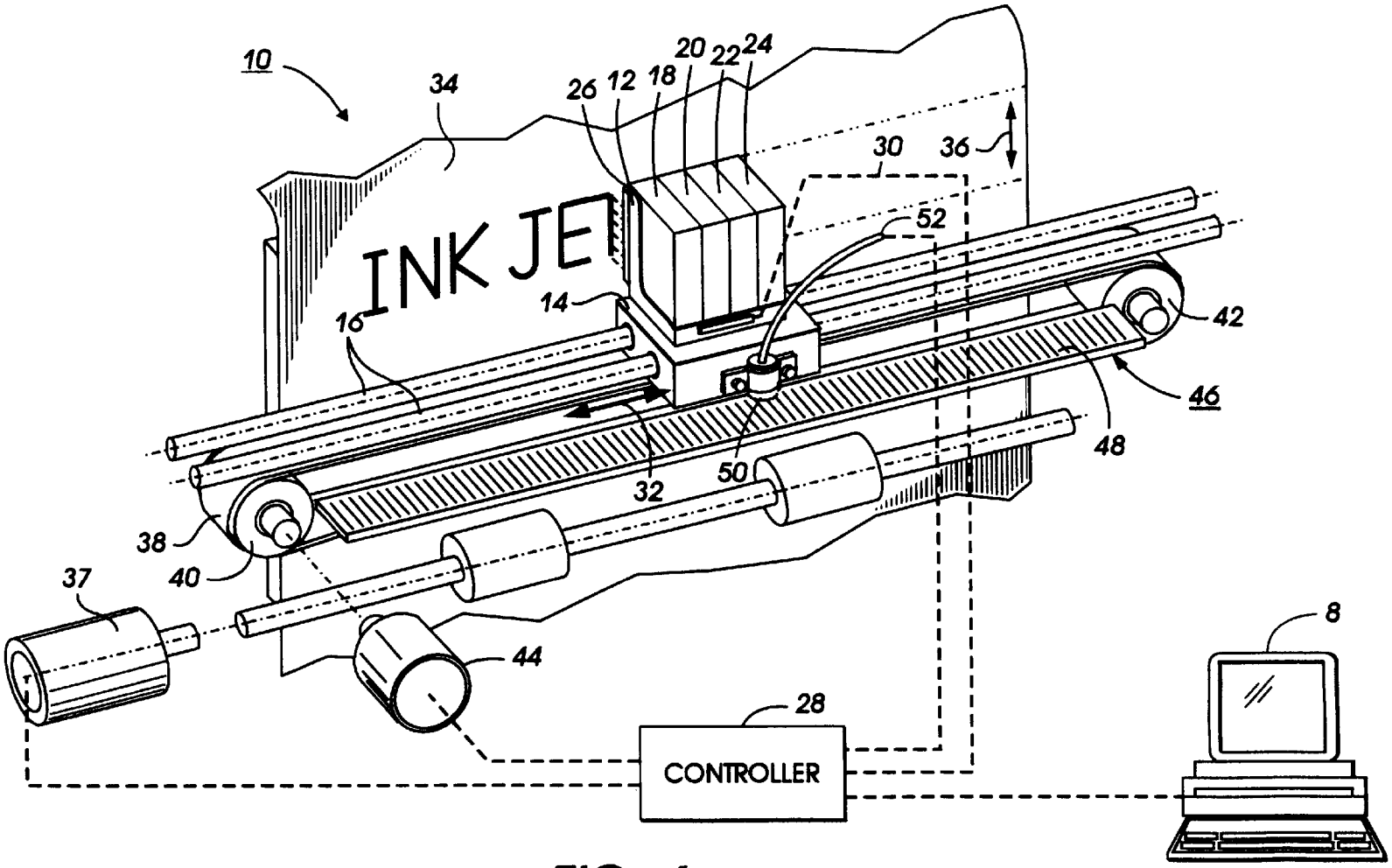
FIG. 1 is a partial schematic perspective view of a printing system incorporating the present invention.

FIG. 1 illustrates a partial schematic perspective view of a printing system including a personal computer 8, generating print data, coupled to one type of liquid ink printer, an ink jet printer 10, having an ink jet printhead housing 12 mounted on a carriage 14 supported by carriage rails 16. The printhead housing 12 includes a four ink tanks, for example, 18, 20, 22 and 24, each containing ink, for instance, cyan, magenta, yellow and black, for supply to a thermal ink jet printhead 26 which selectively expels droplets of ink under control of electrical signals received from a controller 28 of the printer 10 through an electrical cable 30. Other types of ink tanks or cartridges are possible including combined ink tanks having multiple colors not separable by a user. The signals generated by the controller 28 are generated in response to the print data generated by the personal computer 8 as is understood by one skilled in the art. Other image input devices are also possible, of course, such as a scanner, other computer image generators, and image storage devices. Such image data may include color information or monochrome information for printing by a color capable liquid ink printer.

The printhead 26 contains a plurality of drop ejectors, including ink conduits or channels (not shown) which carry ink from the ink tanks 18, 20, 22 and 24 to respective ink ejectors, which eject ink through orifices or nozzles (also not shown). When printing, the carriage 14 reciprocates or scans back and forth along the carriage rails 16 in the directions of an arrow 32, at a constant speed or velocity. As the printhead cartridge 12 reciprocates back and forth across a recording medium 34, such as a sheet of paper or transparency, droplets of ink are expelled from selected ones of the printhead nozzles towards the sheet of paper 34. The ink ejecting orifices or nozzles are typically arranged in a linear array substantially perpendicular to the scanning direction 32. If printing in color, such a linear array can be segmented such that segments of the array deposit different colors of ink to complete a color image. It is also possible that each of the ink tanks be connected to or include an individual linear nozzle array such that the printer includes four linear arrays, one for each ink. Combinations of segmented arrays and individual arrays are also possible. During each pass of the carriage 14, the recording medium 34 is held in a stationary position. At the end of each pass, however, the recording medium is advanced or stepped in a paper advance direction 36 by a stepping mechanism or electromover, such as paper advance motor 37, under control of the printer controller 28. For a more detailed explanation of the printhead and printing thereby, refer to U.S. Pat. No. 4,571,599, U.S. Pat. No. Reissue 32,572, and U.S. Pat. No. 5,534,895 each of which are incorporated herein by reference.

It is well known and commonplace to program and execute imaging, printing, document, and/or paper handling control functions and logic with software instructions for conventional or general purpose microprocessors, such as the controller 28. This is taught by various prior patents and commercial products. Such programming or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

The carriage 14 is moved back and forth in the scanning directions 32 by a belt 38 attached thereto. The belt 38 is moved by a first rotatable pulley 40 and a second rotatable pulley 42. The first rotatable pulley 40 is, in turn, driven by a reversible motor 44 under control of the controller 28 of the ink jet printer. In addition to the toothed belt/pulley system for causing the carriage to move, it is also possible to control the motion of the carriage by using a cable/capstan, lead screw or other mechanisms as known by those skilled in the art.

To control the movement and/or position of the carriage 14 along the carriage rails 16, the printer includes an encoder having an encoder strip 46 which includes a series of fiducial marks in a pattern 48. The pattern 48 is sensed by a sensor 50, such as a photodiode/light source attached to the printhead carriage 14. The sensor 50 includes a cable 52 which transmits electrical signals representing the sensed fiducial marks of the pattern 48 to the printer controller to thereby measure actual printhead position. Other known encoders, such as rotary encoders are also possible.

Figure 2:
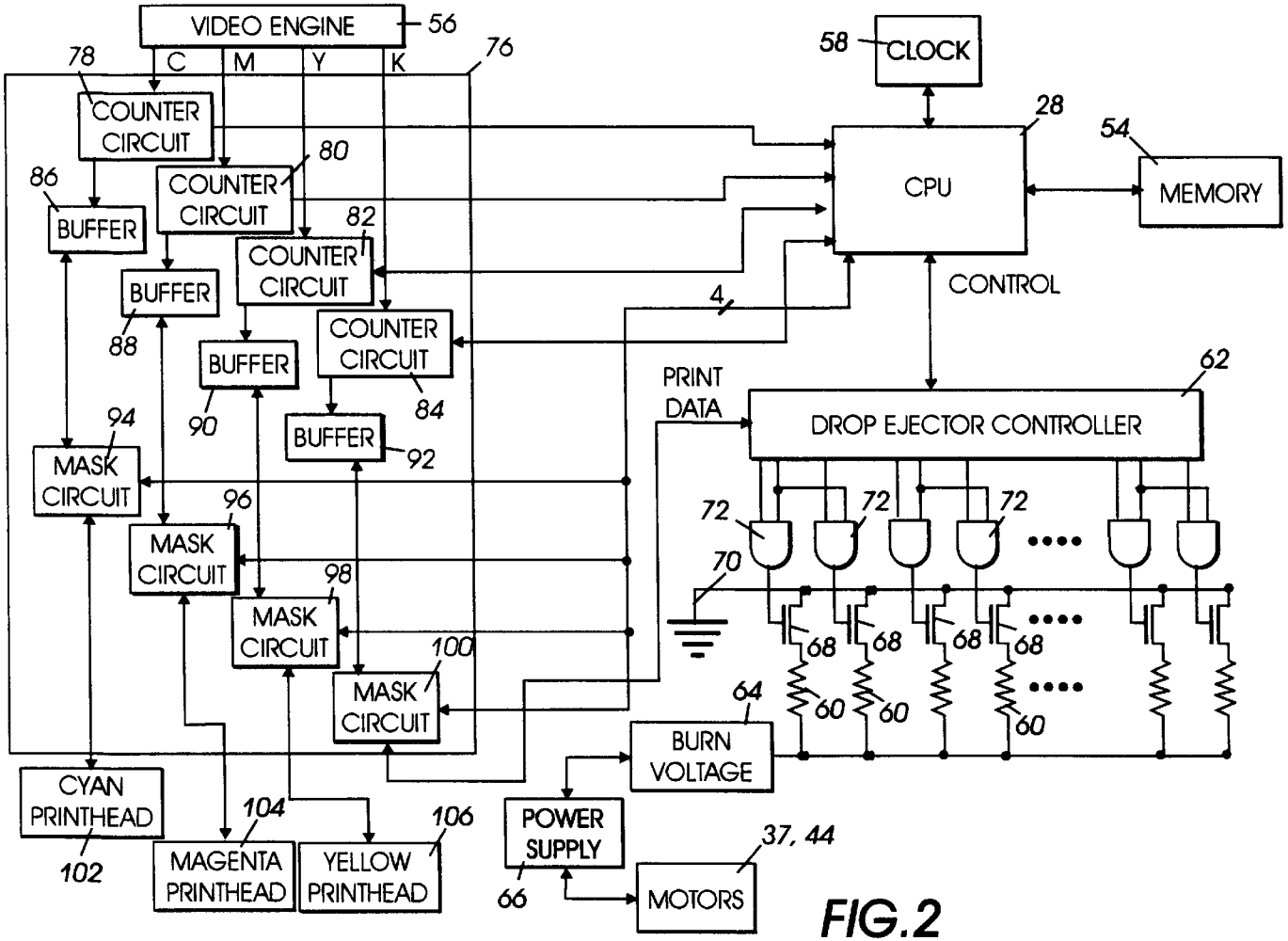
FIG. 2 illustrates a block diagram of an electronic circuit for an ink jet printer incorporating aspects of the present invention.

FIG. 2 illustrates a block diagram of an electronic circuit for an ink jet printer incorporating the present invention. The ink jet printer 10 includes the controller or central processing unit (CPU) 28 which controls the operation of the printer including various circuitry such as, paper feed driver circuits, carriage motor control circuits, and user interface circuitry. The CPU 28 typically communicates over a bus with the various printer circuits and a memory 54 which includes read only memory (ROM) and/or random access memory (RAM). The read only memory can include an operating program for the CPU 28 for controlling the printer and the random access memory can include accessible memory including print buffers for the manipulation of data and for the storage of printing information in the form of bitmaps received from an input device such as a video engine 56. The video engine 56 can be found in any number of devices generating print data including a personal computer or a scanner such as that found in a facsimile machine. In addition, the CPU 28 under control of a clock 58 which is used to control various timing operations throughout the printer as is known by those skilled in the art.

The CPU 28 also controls the ejection of ink from the nozzles each of which is associated with a respective heater 60 through operation of a drop ejector controller 62. In one particular embodiment, a thermal ink jet printhead includes an integrated circuit having 384 of the thermal ink jet heaters 60, spaced at 600 spots per inch (spi), which are powered by a burn voltage 64 which is typically around 40 volts. A power supply 66, having a maximum power rating determined according to the present invention as described herein, supplies the power for the burn voltage 64, and may supply power to the carriage motor 44, as well as to the motor 37 and a maintenance function motor (not shown) as known by those skilled in the art. Each of the heaters 60 is additionally coupled to a power MOS FET driver 68 coupled to a ground 70. The drivers 68 energize the heaters 60 for expelling ink drops from the nozzles. While, the present invention is applicable to any number of ink jet heaters 60, however, six heaters 60 are shown in FIG. 2 for illustrative purposes. Selective control of each of the drivers 68 is accomplished by an AND gate 72 having the output thereof coupled to the gate of the driver 68. The AND gates allow for the sequential firing of banks or segments of the nozzle array wherein each bank includes two or more nozzles. The drop ejector controller 62 receives control information from the CPU to simultaneously energize each heater within a bank and to sequentially fire each bank of heaters 60 as described in U.S. Pat. No. 5,300,968, which is incorporated herein by reference. As by example, a bi-directional shift register can control a 384 nozzle ink jet printhead where twenty-four adjacent heaters are energized simultaneously and the sixteen banks of the heaters are controlled sequentially.

It has been found that thermal ink jet printing is basically an on-demand printing system that requires almost no power at idle conditions but which requires large amounts of power during printing of areas including high area coverage. These power requirements tend to come in bursts as the printhead assemblies are operated. Most printed documents typically require less than 10% coverage on the average. When using color printers, printing in color, however, coverage of as high as 150% to 200% coverage is necessary. This implies 1.5 to 2 layers of ink. Such areas of high ink coverage result in significant power excursions over the length of the printed swath.

It is, therefore, desirable to design a system which tends to attenuate the peak excursions or peak power requirements to provide for a cost effective power management solution i.e. a low cost power supply, while enabling proper printing of both low and high area coverage documents. One known method is to utilize a control system that anticipates the power requirements on a swath by swath basis and varies the print speed in proportion to the density of the image. Such a solution, however, poses certain problems with carriage type ink jet printers. For instance, ink jet printers which deposit droplets of ink should be operated such that the carriage speed of the printhead remains constant during printing of the entire swath, especially if completed in multiple passes. Constant print speed is a necessary requirement since it has been found that ink drops ejected from nozzles will have different shapes after deposition on the print medium according to the speed of the carriage. In addition, the landing point of the ink drops will also vary with respect to the ejection point when print speeds or carriage speeds are varied. Likewise, a phenomenon known as satellites, multiple small droplets of ink which split off from the main droplet of ink upon ejection, will also have behaviors which vary according to the speed of the printhead as it travels across the recording medium. Consequently, speeding up or slowing down the printhead carriage to accommodate for changes in image density does not provide a desirable solution to controlling the peak power requirements of a liquid ink printer.

The present invention, therefore, provides a method and apparatus for anticipating the power requirements necessary to print an image on a swath by swath basis and varies the image data via multiple screened image passes in quantum proportion to the density of the image. For instance, in an illustrative printer which can print up to 200% image density (2 layers of ink), having a printhead assembly comprised of four 600 spi, 384 nozzle print die mounted side by side, each one respectively printing magenta, cyan, yellow and black inks, and wherein each printhead is fired in 16 banks of 24 adjacent nozzles at a 9 kilohertz repetition rate, a power supply designed for normal full speed printing for all cases would require approximately 180 watts of output power. Using the present invention, however, a printing system is provided that anticipates the density of a swath to be printed and utilizes one-half and one-quarter tone masks, where the maximum number of passes to complete a single print swath is four. The power supply for such a system would require approximately 45 watts of power as compared to the previously required 180 watts of output power. Any swath of less than 50% area coverage requires only a single pass wherein no mask is needed. For coverage of greater than or equal to 50% but less than 100%, two passes of the printhead are necessary using two complementary one-half tone checkerboard patterns. For coverage which is greater than or equal to 100%, four passes of the printhead would be necessary to complete printing of the entire swath using four complementary one-quarter tone masks. It is, of course, possible to increase the maximum number of passes necessary to complete the printing of a single swath such that the power rating of the power supply can be further reduced.

Returning to FIG. 2, the video engine 56, in the described embodiment, generates four bitmaps each one corresponding respectively to a cyan, magenta, yellow, and black color plane. The video engine transmits a single swath of information from each of the respective bitmaps to a print power regulation circuit 76 which receives the image data through a plurality of inputs (or serially) and transmits the image data in a number of passes per swath wherein the number of passes per swath is determined as a function of the maximum power rating of the power supply 66.

The maximum power rating of the supply 66 is determined as a function of the drop ejector behavior, that is, the maximum number of drop ejectors ejecting ink at any one time and the power supply rating necessary for the particular printer. If, for instance, completion time of printing a page of information is most important then it might be that two passes of the printhead to complete a single swath of information would be more desirable than having a power supply with a relatively low power rating. In the present example, the power supply rating would be doubled to 90 watts of capability and only a one-half tone mask would be used. If, for instance, the power supply is being designed for a low cost printer, then the power supply might be selected to have a low power rating such as the described 45 watts of capability and the number of passes for completing printing of a swath of image data at maximum coverage would be selected to be four. As can be seen, both the maximum number of passes per swath and the power rating can be varied with respect to one another to achieve an optimum design.

Once the power supply rating and the maximum number of passes per swath have been selected, drop ejector behavior information is generated as a function of the selected relationship and is stored in a memory location for access during operation of the liquid ink printer. For instance, in the present embodiment, the power supply is rated at 45 watts and a selection of no mask, one-half tone mask and a one-quarter tone mask is made available depending on the area coverage of the particular swath in question. The controller 28 receives from the print power regulation circuit, a signal indicating the ink coverage of each swath of each color image plane which has been determined respectively by a cyan counter circuit 78, a magenta counter circuit 80, a yellow counter circuit 82 and a black counter circuit 84. When the swath contains pixel information in the form of a bitmap of ones and zeros, each of the counter circuits respectively counts the number of pixels within a swath and the print power regulation circuit transmits this information to the central processing unit 28. The CPU then analyzes the transmitted information accordingly to known and well understood programming techniques. The drop ejector behavior information could be stored in the memory 54 or could be imbedded and stored in an ASIC comprising the CPU and the memory. Once the CPU has analyzed the received information from each of the counter circuits, the CPU 28 transmits the results of the analysis or calculation to the print power regulation circuit 76.

Once each of the counter circuits 78, 80, 82 and 84 has counted the number of pixels within the swath of information, the pixel information is stored respectively in a cyan buffer 86, a magenta buffer 88, a yellow buffer 90 and a black buffer 92. Each of these buffers includes the entirety of the image data for a single swath of information from each of the colors. The control information transmitted from the CPU 28 to the print power regulation circuit 76 is transmitted to a respective cyan mask circuit 94, a magenta mask circuit 96, a yellow mask circuit 98 and a black mask circuit 100. Each of the mask circuits then applies a selected mask according to the information received from the CPU 28 to the information contained in the respective buffers. For instance, if it has been determined that each of the swaths includes an image coverage greater than 100%, then the respective mask circuits would apply one-quarter tone screens to the information contained in each of the respective buffers such that four passes of the printhead are necessary to complete ink coverage with the one-quarter tone screens being changed with each pass of the printhead. The mask circuit transmits upon each pass one-quarter of the tone information to a cyan printhead 102, a magenta printhead 104, a yellow printhead 106 and the black printhead here shown in more detail as including the heaters 60.

Figure 3:
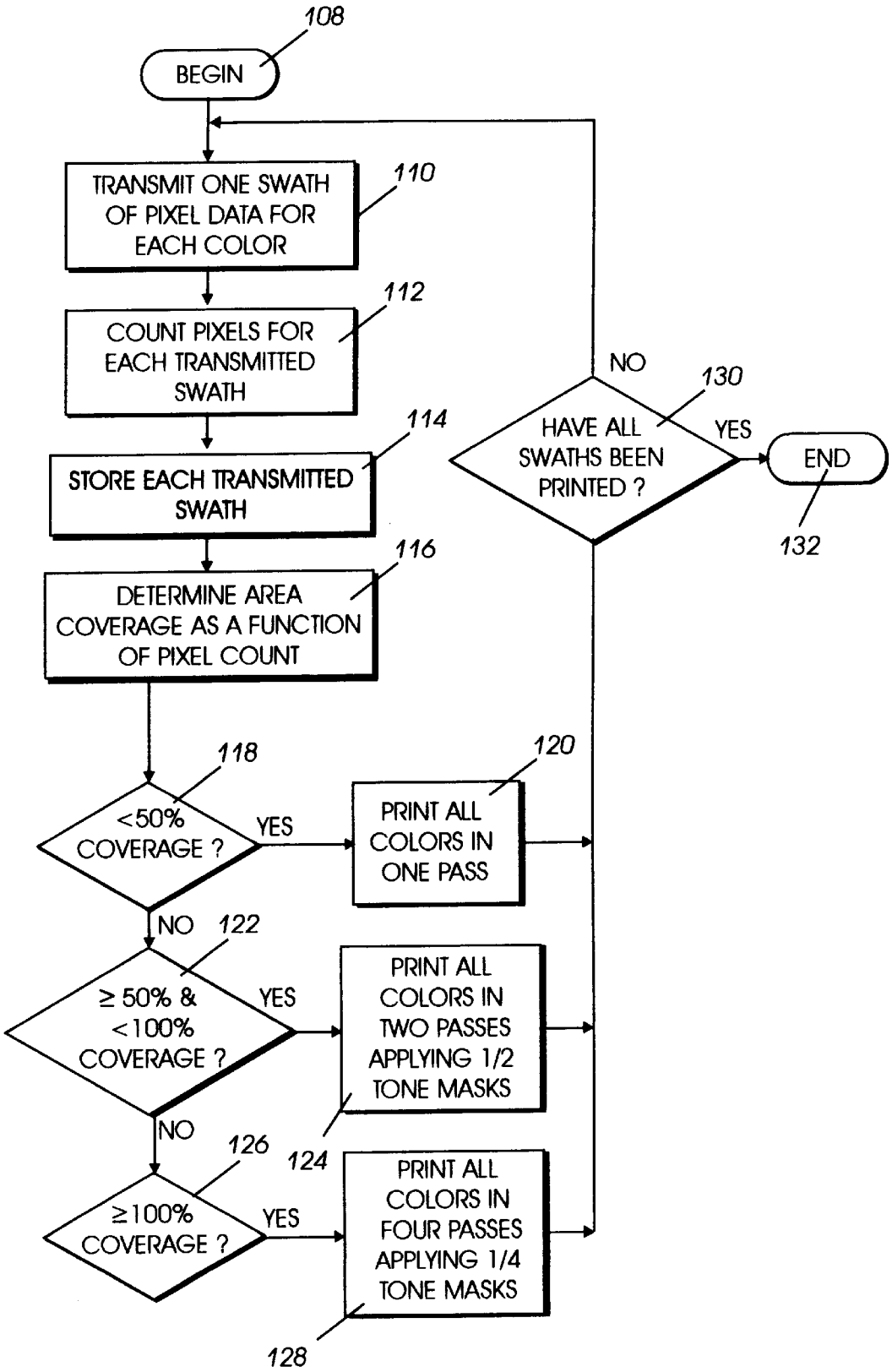
FIG. 3 is a flow diagram illustrating a maintenance operation for selectively ejecting purge drops from the nozzles of a printhead.

FIG. 3 illustrates a flow chart of the present invention. The process begins at step 108 after which one swath of pixel data is transmitted for each color from the video engine 56, for instance, as illustrated at step 110. At step 112, the image is analyzed by an image analyzer circuit, such as the described counter circuits 78, wherein the pixels are counted for each transmitted swath. Each of the transmitted swaths is stored in a respective buffer at step 114. The area covered is determined by a pass determining circuit, such as the CPU 28, which determines the area coverage as a function of the pixel count at step 116. The pass determining circuit, determines based on the area coverage whether or not there is less than 50% coverage at step 118. If yes, all colors are printed in one pass at step 120. If no, however, the pass determining circuit determines whether or not the area coverage is greater than or equal to 50% and/or less than 100% at step 122. If yes, then all of the colors are printed in two passes at step 124 of the printhead applying one-half tone masks. If no, then it is, of course, determined that the area coverage is greater than 100%, at step 126, and that each color is printed in four passes of the printhead applying a different one-quarter tone mask four times such that the complete image data of a single swath is printed at step 128. After the completion of each swath, the CPU 28 determines at step 130 if all of the swaths have been printed. If no, the routine returns to step 110 to repeat the process for the next swath. If, however, all swaths have been printed, then the entire document is complete and the process ends at step 132.

In recapitulation, there has been described an apparatus and method for a multiple pass ink jet printer with an optimized power supply. It is, therefore, apparent that there has been provided in accordance with the present invention, an ink jet printer that fully satisfies the aims and advantages hereinbefore set forth. While this invention has been described in conjunction with a specific embodiment thereof, it is evident that many alternatives, modifications, and variations will be apparent to those skilled in the art. The present invention is not limited to thermal ink jet printers, however, but is equally applicable to other liquid ink printers including piezoelectric and acoustic ink printers. Accordingly, it is intended to embrace all such alternatives, modifications and variations that fall within the spirit and broad scope of the appended claims.

What is claimed is:

1. A multiple pass ink jet printer with a power supply having reduced peak power in which liquid ink droplets are deposited on a recording medium in swaths to form an ink image in response to image data received thereby, comprising:

a translatable printhead with at least one ink supply tank, the printhead having a plurality of nozzles and selectively addressable heating elements for ejecting ink droplets from the nozzles;

means to translate the printhead back and forth across the recording medium at a constant speed;

a power supply having a selected maximum power rating that is less than that required to print ink images having high ink density;

a central processing unit with a memory containing information on power requirement behavior for said heating elements and said selected power supply maximum power rating, the central processing unit coupling the power supply to the printhead heating elements for effecting droplet ejection and for controlling the means to translate the printhead;

a print power regulation circuit for receiving image data and determining an ink density per swath required to be printed by the printhead to produce an ink image of said image data on the recording medium, the print power regulation circuit sending a signal indicative of said required ink density per swath to be printed by the printhead to the central processing unit; and said central processing unit determining the number of printhead passes required to print a complete swath of the ink image upon receipt of the signal from the print power regulation circuit by using the information in said memory for the power requirement behavior for the heating elements and the selected maximum power rating of the power supply, so that the power required for the heating elements during any one pass of the printhead while printing a swath does not exceed the selected maximum power rating of the power supply, and said central processing unit causing the means to translate the printhead to effect the determined number of passes to print the swaths and to selectively address the printhead heating elements to form the ink image on the recording medium.

2. The ink jet printer of claim 1, wherein the image data comprises a bitmap, including a plurality of pixels; wherein the central processing unit effects the ejection of ink droplets from the nozzles through an ejector controller; and wherein the print power regulation circuit comprises at least one counter circuit which determines the ink density of each swath of ink image to be printed by counting the number of pixels within the swath and at least one buffer for storing an entire swath of image data.

3. A method for printing ink images with a multiple pass ink jet printer having a power supply which has reduced peak power and a printhead having selectively energizable heating elements and nozzles from which liquid ink droplets are ejected and deposited on a recording medium to form an ink image in response to receipt of image data by said printer and the printer's selective energization of the heating elements, comprising the steps of:

providing the printer with a central processing unit having a memory;

determining a power value to energize each of the heating elements;

providing a power supply having a selected maximum power rating that is less than that required to print ink images having high ink density;

storing the power value for the heating elements and the power rating of the power supply in the memory;

generating bitmaps of the image data received by the printer;

transmitting single swaths of information from the bitmaps to a counter circuit;

counting a number of pixels in the swath by the counter circuit in response to receipt of the bitmaps and generating a count signal representing the pixel count, said count signal being indicative of the ink density of the swath;

sending the count signal indicative of the ink density of the swath to the central processing unit;

using the central processing unit to access the memory and to calculate the number of passes of the printhead that are necessary to print the entire ink density of each swath of information in response to the count signal, so that the power required by the heating elements do not exceed the selected power rating of the power supply in any one pass of the printhead during the printing of a swath;

generating a pass signal from the central processing unit which is representative of the number of passes per swath calculated by the central processing unit;

storing the entire number of pixels within the swath from the counter circuit in a buffer;

sending the pass signal from the central processing unit to a mask circuit which applies a mask to the pixels stored in the buffer to reduce the ink density per swath for each pass of the printhead according to the pass signal;

transmitting the masked pixels per pass for each swath from the mask circuit to the printhead; and translating the printhead back and forth across the recording medium at a constant speed in response receipt of the masked pixels to print the masked pixels onto the recording medium for each of the passes calculated by the central processing unit, so that the power required for the heating elements during any one pass of the printhead does not exceed the selected maximum power rating of the power supply.

* * * * *